US008043068B2

(12) United States Patent
Imano et al.

(10) Patent No.: US 8,043,068 B2
(45) Date of Patent: Oct. 25, 2011

(54) NI-FE BASED SUPER ALLOY, PROCESS OF PRODUCING THE SAME AND GAS TURBINE

(75) Inventors: Shinya Imano, Hitachi (JP); Hiroyuki Doi, Tokai (JP); Isao Takehara, Hitachi (JP); Shigeo Sakurai, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 535 days.

(21) Appl. No.: 11/206,131

(22) Filed: Aug. 18, 2005

(65) Prior Publication Data

US 2006/0088411 A1 Apr. 27, 2006

(30) Foreign Application Priority Data

Oct. 25, 2004 (JP) ..... 2004-309032

(51) Int. Cl.
*F01D 5/14* (2006.01)

(52) U.S. Cl. ..... 416/241 R; 416/198 A

(58) Field of Classification Search ..... 416/201 R, 416/198 R

See application file for complete search history.

(56) References Cited

U.S. PATENT DOCUMENTS 4,514,360 A * 4/1985 Giamei et al. ..... 420/454
4,979,995 A 12/1990 Hattori et al.
5,593,274 A * 1/1997 Carreno et al. ..... 415/115
5,860,789 A * 1/1999 Sekihara et al. ..... 416/201 R
6,053,701 A * 4/2000 Ichiryu et al. ..... 416/96 R
6,315,846 B1 11/2001 Hibner et al.
6,464,461 B2 * 10/2002 Wilson et al. ..... 416/96 R
6,491,495 B1 * 12/2002 Marushima et al. ..... 416/96 R
6,746,208 B2 * 6/2004 Marushima et al. ..... 416/96 R

FOREIGN PATENT DOCUMENTS

EP 1 486 578 12/2004
JP 62044546 * 2/1987
JP 63-171856 7/1988
JP 07-138719 5/1995
JP 10-226837 8/1998
JP 2004-036469 2/2004

OTHER PUBLICATIONS

Imano, Shinya, "Mechanical Property and Miscrostructure of low Nb and High Al Ni-Fe Base Superallow (IN706)", CAMP-ISIJ, vol. 15, 2003, p. 535.

Heino, S. et al, "Cyclic Deformation and Fatigue Behaviour of 7Mo-0.5N Superaustenitic Stainless Steel-Stress-Strain Relations and Fatigue Life", Acta mater. 49, 2001, pp. 339-347.

G.I. Nosova et al, "Decomposition of the Supersaturated Solid Solution in Ni-Cr-Fe-Nb-Al Alloys and Their Heat Treatment", Metal Science and Heat Treatment, 33(1991) May/June, Nos. 5/6, pp. 376-379.

* cited by examiner

*Primary Examiner* — Justine Yu
*Assistant Examiner* — Aaron R Eastman
(74) *Attorney, Agent, or Firm* — Mattingly & Malur, PC

(57) ABSTRACT

A Ni—Fe based super alloy having high strength and toughness at high temperatures even when used in high-temperature environments, and a process of producing the super alloy. A turbine disk using the super alloy, a process of producing the turbine disk, a turbine spacer using the super alloy, and a process of producing the turbine spacer, as well as a gas turbine are also provided. The Ni—Fe based super alloy contains not more than 0.03% by weight of C, 14-18% of Cr, 15-45% of Fe, 0.5-2.0% of Al, not more than 0.05% of N, 0.5 to 2.0% of Ti, 1.5-5.0% of Nb, and Ni as a main ingredient.

6 Claims, 7 Drawing Sheets

NI-FE BASED SUPER ALLOY, PROCESS OF PRODUCING THE SAME AND GAS TURBINE

BACKGROUND OF THE INVENTION

1. Field of the Invention

The present invention relates to a novel Ni—Fe based super alloy and a process of producing the super alloy. Also, the present invention relates to a turbine disk using the super alloy, a process of producing the turbine disk, a turbine spacer using the super alloy, and a process of producing the turbine spacer, as well as to a gas turbine.

2. Description of the Related Art

Increasing combustion temperature is effective to increase the efficiency of power generation in a gas turbine power plant. A rotor as a rotating component of the gas turbine comprises a turbine stub shaft and a plurality of turbine disks coupled to the turbine stub shaft by turbine stacking bolts with turbine spacers each interposed between adjacent turbine disks.

The rotor is not directly exposed to combustion gases and is cooled by using a part of compressed air used for combustion. Therefore, temperatures of the above-mentioned rotor components are fairly lower than those of turbine (rotating) blades and turbine (stator) nozzles which are directly exposed to the combustion gases. Therefore, 12Cr steel disclosed in Patent Document 1; JP,A 63-171856 has been used in the turbine rotor so far. With a recent increase of the combustion temperature and the compression rate, however, Ni—Fe based super alloys containing Fe and having superior high-temperature strength, such as IN718 and IN706, have become more commonly used. In those alloys, the γ" phase ($Ni_3Nb$) is finely precipitated with addition of Nb, whereby a superior strength characteristic is obtained. Also, those alloys have superior productivity in making a large-sized ingot in spite of being the Ni based super alloys.

Patent Document 2; JP,A 10-226837 discloses, as an improved material of IN706, a Ni—Fe based super alloy containing not less than 0.05% by weight of C+N, 10-20% of Cr, 25-45% of Fe, 0.5-2.0% of Al, 1.0-2.0% of Ti, and 1.5-3.0% of Nb.

Further, Non-Patent Document 1; CAMP-ISIJ, VOL. 15 (2003)—535p, states that regarding an alloy containing 0.3-1.5% of Al and 1.8-3.0% of Nb as an improved material of IN706, the γ" phase is not observed and only the γ' phase is observed.

SUMMARY OF THE INVENTION

IN706 and IN718 have superior properties as being materials of the gas turbine rotor at temperatures of not higher than 500° C. As described above, IN706 and IN718 are strengthened with precipitation of the γ" phase and exhibit a high strength characteristic. However, the γ" phase is thermodynamically so unstable that, when exposed to high temperatures for a long time, the γ" phase is lost and the η phase known as being detrimental to the super alloy is precipitated instead. For that reason, the temperatures suitable for use with IN706 and IN718 are limited. On the other hand, from the viewpoint of further increasing the efficiency of the gas turbine, gas turbine rotor materials usable for a long time at temperatures of not lower than 500° C. are required and materials having more excellent high-temperature characteristics than IN706 and IN718 are demanded.

In any of IN706 and the super alloy disclosed in Patent Document 2, when it is used in high-temperature environments, deterioration occurs in strength and toughness at high temperatures. Also, Non-Patent Document 1 does not clearly specify an alloy composition.

An object of the present invention is to provide a Ni—Fe based super alloy having high strength and toughness at high temperatures even when used in high-temperature environments, and a process of producing the super alloy. Another object is to provide a turbine disk using the super alloy, a process of producing the turbine disk, a turbine spacer using the super alloy, and a process of producing the turbine spacer, as well as a gas turbine.

To achieve the above object, the present invention provides a Ni—Fe based super alloy containing not more than 0.03% by weight of C, 14-18% of Cr, 15-45% of Fe, 0.5-2.0% of Al, not more than 0.05% of N, 0.5 to 2.0% of Ti, 1.5-5.0% of Nb, and Ni as a main ingredient.

Preferably, the balance is essentially Ni. The super alloy contains Nb in amount decided from a formula given below:

$$Nb=3.5 \text{ to } 4.5-(Fe/20)$$

A composition of the super alloy satisfies at least one of 0.005-0.03% by weight of C, 1.0-2.0% of Al, 1.3 to 2.0% of Ti, and 0.005-0.05% of N. More preferably, the super alloy has those features in a combined manner.

Also, preferably, contents of Nb and Fe are within a region defined by successively connecting a point A (Nb 3.0%, Fe 15%), a point B (Nb 3.0%, Fe 30%), a point C (Nb 2.25%, Fe 45%), a point D (Nb 1.25%, Fe 45%), a point E (Nb 2.75%, Fe 15%), and the point A when Nb and Fe are represented on a two-dimensional coordinates in terms of weight ratio. The C content is 0.005-0.03% by weight, and the super alloy is subjected to aging treatment after plastic working with hot forming. More preferably, the super alloy has those features in a combined manner.

To achieve the above object, the present invention further provides a process of producing a Ni—Fe based super alloy, comprising the steps of forming, by vacuum fusion, a forging material containing not more than 0.03% by weight of C, 14-18% of Cr, 15-45% of Fe, 0.5-2.0% of Al, not more than 0.05% of N, 0.5 to 2.0% of Ti, 1.5-5.0% of Nb, and Ni as a main ingredient, and successively performing hot plastic working, solution treatment and two-stage aging treatment on the forging material. Preferably, the aging treatment is performed in two stages comprising heat treatment at 680-750° C. and subsequent heat treatment at 580-650° C. After forming the forging material by vacuum fusion, the forging material is melted and formed again by electroslag fusion.

To achieve the above object, the present invention still further provides a turbine disk being a disk-shaped member having turbine-blade mount portions in a circumferential region thereof, and a turbine spacer being a ring-shaped member which is disposed between adjacent turbine disks each having the turbine-blade mount portions in the circumferential region of the disk and is coupled integrally with the turbine disks by bolts, the turbine disk and the turbine space being made of the Ni—Fe based super alloy described above. In addition, the present invention provides a process of producing each of the turbine disk and the turbine spacer in accordance with the above-described process of producing the Ni—Fe based super alloy.

To achieve the above object, the present invention still further provides a gas turbine comprising a turbine stub shaft, a plurality of turbine disks coupled to the turbine stub shaft by turbine stacking bolts with turbine spacers each interposed between adjacent turbine disks, turbine blades mounted to the turbine disks and rotated by high-temperature combustion gases, a distant piece coupled to the turbine disk, a plurality of compressor disks coupled to the distance piece, compressor blades mounted to the compressor disks and compressing air, and a compressor stub shaft integrally coupled to a first stage of the compressor disks, wherein at least one of the turbine disks and the turbine spacers is made of the Ni—Fe based super alloy described above.

The inventors have conducted studies on the relation between the high-temperature strength and the structure of IN706. To increase the fatigue strength and toughness of IN706, it is tried in Patent Document 2 to improve characteristics with a reduction in sizes of crystal grains by increasing the amounts of C and N added and increasing the amount of NbC precipitated. On that occasion, Nb in $Ni_3Nb$ (γ' phase) serving as a precipitated strengthening phase is captured by NbC and the amount of $Ni_3Nb$ (γ" phase) is reduced, thus resulting in, e.g., a 0.2% reduction of the yield point. On the other hand, such a try shows that the reduction in strength can be compensated for by adding Al and precipitating $Ni_3Al$, i.e., a single-crystal Ni based alloy that serves as a precipitated strengthening phase, and that $Ni_3Al$ precipitated with addition of Al is stable at 700° C. Comparing with $Ni_3Nb$, $Ni_3Al$ is not only more stable at high temperatures, but also more superior in high-temperature strength. Therefore, the γ'-phase strengthened Ni—Fe based super alloy disclosed in Non-Patent Document 1 is a promising material. However, the yield point at 500° C. or below is lower than that of the known γ"-phase strengthened Ni—Fe based super alloy, and an improvement in the yield point is required when the γ'-phase strengthened Ni—Fe based super alloy is used under high stresses.

In Patent Document 2, the amounts of C and N added are increased for the purpose of reducing the sizes of crystal grains with importance placed on the fatigue strength. However, NbC is very poor in oxidation resistance and brings about a crack start point because NbC exposed to the material surface and its surroundings are very easily susceptible to oxidation, thus causing a serious problem of oxidation particularly at high temperatures. It is hence not desired that NbC be precipitated in large amount. The inventors have focused attention on the fact that carbides are precipitated in two forms in a super alloy system to which the present invention pertains. More specifically, in this super alloy system, there are present NbC containing Nb in larger amount and TiC containing Ti in larger amount. Both of NbC and TiC are able to dissolve N in a solid state and form Nb(C,N) and Ti(C,N), respectively. Also, with an increase in the amount of N added, the amount of Nb(C,N) is reduced, while the amount of Ti(C,N) is increased. Comparing with Nb(C,N), Ti(C,N) is superior in oxidation resistance characteristic and is less apt to become the crack start point. In this way, the inventors have found that, by reducing the amount of C added and increasing the amount of N added, finer crystal grains can be formed with dispersion of carbides without increasing the number of crack start points.

Also, the inventors have found that N has an action of increasing the strength with solid solution and, by increasing the amount of N added, the problem of a reduction in the yield point can be overcome so as to provide the yield point comparable to that in the known material. As the temperature in use increases, the creep strength also becomes important in addition to the fatigue strength. Since higher creep strength is obtained with a larger crystal grain size, the amount of N added is relatively held down when the super alloy is used in a very high-temperature range.

Non-Patent Document 1 states that a higher Al content and a lower N content are effective in increasing high-temperature structure stability and high-temperature strength, but it includes no suggestions regarding proper amounts of other elements added, particularly proper amounts of C and N added. As a result of trying to improve the super alloys of Non-Patent Document 1 and Patent Document 2 particularly in points of the amounts of C and N added, the inventors have found that content ranges of individual ingredient, explained below, are suitable for a gas turbine rotor material.

The amount of Al added is required to be not less than 0.5% from the viewpoints of compensating for the reduction in strength caused by a lower Nb content and of increasing the structure stability. However, excessive addition of Al would deteriorate formability with an excessive increase of $Ni_3Al$. Hence the amount of Al added is required to be not more than 2.0%. From the practical point of view, the Al content is preferably 1.0-2.0% and more preferably 1.0-1.5%. Also, taking into account that the Al content and the C content are closely related to each other, a (C/Al) ratio is preferably 0.01-0.20 and more preferably 0.02-0.10 in terms of atomic ratio.

Addition of Ti increases the amount of Ti(C,N) that has more excellent oxidation resistance characteristic, is less apt to become the crack start point, and is more effective in increasing the structure stability than Nb(C,N). Therefore, the amount of Ti added is required to be not less than 0.5%. However, excessive addition of Ti would deteriorate the formability. Hence the amount of Ti added is required to be not more than 2.0%. From the practical point of view, the Ti content is preferably 1.0-2.0% and more preferably 1.3-1.7%.

In order to reduce the number of possible crack start points which are caused as described above, the amount of C added is required to be not more than 0.03%. From the practical point of view, the C content is preferably 0.001-0.025% and more preferably 0.005-0.02%.

The amount of N added depends on the temperature and stresses in use. However, excessive addition of N would form coarse TiN when solidified. Accordingly, the amount of N added is required to be not more than 0.05% including no addition (0%). When the super alloy is used in a member subjected to relatively low temperatures and large stresses, the N content is preferably 0.03-0.05%.

The amount of Nb added is desirably to be not more than 5% from the viewpoint of suppressing segregation and is required to be not less than 1.5% from the viewpoint of obtaining high strength. Further, from the viewpoint of suppressing precipitation of the η, σ and δ phases which are detrimental precipitated phases, the Nb content preferably satisfies the following relationship with respect to the Fe content of 15-45%:

$$Nb=3.5 \text{ to } 4.5-(Fe/20)$$

Preferably, the Nb content is 2.0-3.5% and the Fe content of 15-35%. More preferably, the contents of Nb and Fe are within the region defined by successively connecting the above-mentioned points A, B, C, D, E and A.

Further, to avoid Nb from forming NbC, the Nb content is preferably adjusted in relation to the C content. From this point of view, a (C/Nb) ratio is preferably 0.01-0.15 and more preferably 0.035-0.10 in terms of atomic ratio.

Mo acts to increase the high-temperature strength with solid solution. Therefore, the amount of Mo added is preferably not more than 5% and more preferably 1-3%.

With the above-mentioned content ranges of the individual ingredient, a Ni—Fe based super alloy can be provided which has productivity comparable or superior to the known IN706 or IN718 and can be used at higher temperatures than the known IN706 or IN718.

Thus, according to the present invention, it is possible to provide a Ni—Fe based super alloy having high strength and toughness at high temperatures even when used in high-temperature environments, and a process of producing the super alloy. Also, a turbine disk using the super alloy, a process of producing the turbine disk, a turbine spacer using the super alloy, and a process of producing the turbine spacer, as well as a gas turbine can be provided.

REFERENCE NUMERALS

1 . . . turbine stub shaft, 2 . . . turbine blade, 3 . . . turbine stacking bolt, 4 . . . turbine spacer, 5 . . . distant piece, 6 . . . turbine nozzle, 7 . . . turbine compartment, 8 . . . combustor, 9 . . . shroud, 10 . . . turbine disk, and 11 . . . through hole.

DESCRIPTION OF THE PREFERRED EMBODIMENTS

The best mode for carrying out the present invention will be described below in connection with practical embodiments.

First Embodiment

Table 1, given below, shows chemical compositions (% by weight) of specimens corresponding to IN706 and examples of Ni—Fe based super alloy of the present invention. Among the specimens shown in Table 1, an alloy 1 corresponds to IN706, and an alloy 2 corresponds to an improved version of IN718. Each of alloys 2-5 corresponds to the Ni—Fe based super alloy of the present invention. The alloys 1-4 present the cases in which N is not added and the N content is negligible because of incapability of analysis.

TABLE 1

| Alloy | Fe | Cr | Nb | Mo | Al | Ti | C | N | Ni |
|---|---|---|---|---|---|---|---|---|---|
| 1 | 35 | 14 | 3 | 0 | 0.2 | 1.6 | 0.03 | <0.001 | balance |
| 2 | 15 | 14 | 5 | 3 | 0.5 | 1.0 | 0.02 | <0.001 | balance |
| 3 | 35 | 14 | 2 | 0 | 1.25 | 1.6 | 0.02 | <0.001 | balance |
| 4 | 15 | 14 | 2.5 | 0 | 1.3 | 1.6 | 0.02 | <0.001 | balance |
| 5 | 35 | 14 | 2 | 0 | 1.25 | 1.6 | 0.01 | 0.03 | balance |

Any of the alloys was produced through the steps of melting and forging raw materials by RF vacuum fusion, and then successively performing, on the forging material, hot plastic working at 800-1100° C., solution treatment at 1000° C. for 2 hours, and two-stage aging treatment that comprises heat treatment at 720° C. for 2 hours and subsequent heat treatment at 620° C. for 8 hours.

Figure 1:
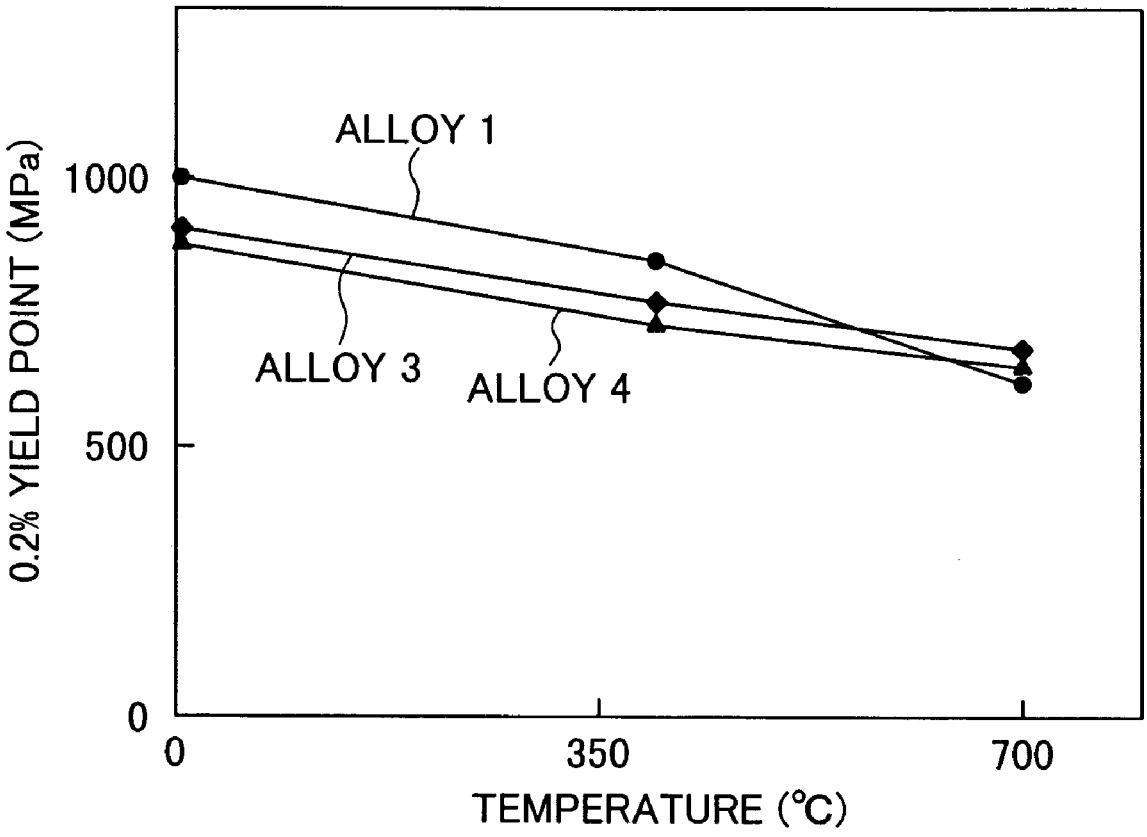
FIG. 1 is a graph showing the relationship between 0.2% yield point and temperature in a Ni—Fe based super alloy according to the present invention.

FIG. 1 is a graph showing the relationship between 0.2% yield point and temperature in the specimens, i.e., the results of tensile tests made on the specimens. As will be seen from FIG. 1, the alloys 3 and 4 of the present invention have the 0.2% yield points slightly inferior to that of the alloy 1 in a relatively low-temperature range of not higher than 350° C., but their 0.2% yield points are superior to the alloy 1 in a relatively high-temperature range near 700° C. Therefore, the alloys of the present invention are more suitable for use at high temperatures than the alloy 1 of the known material.

Figure 2A:
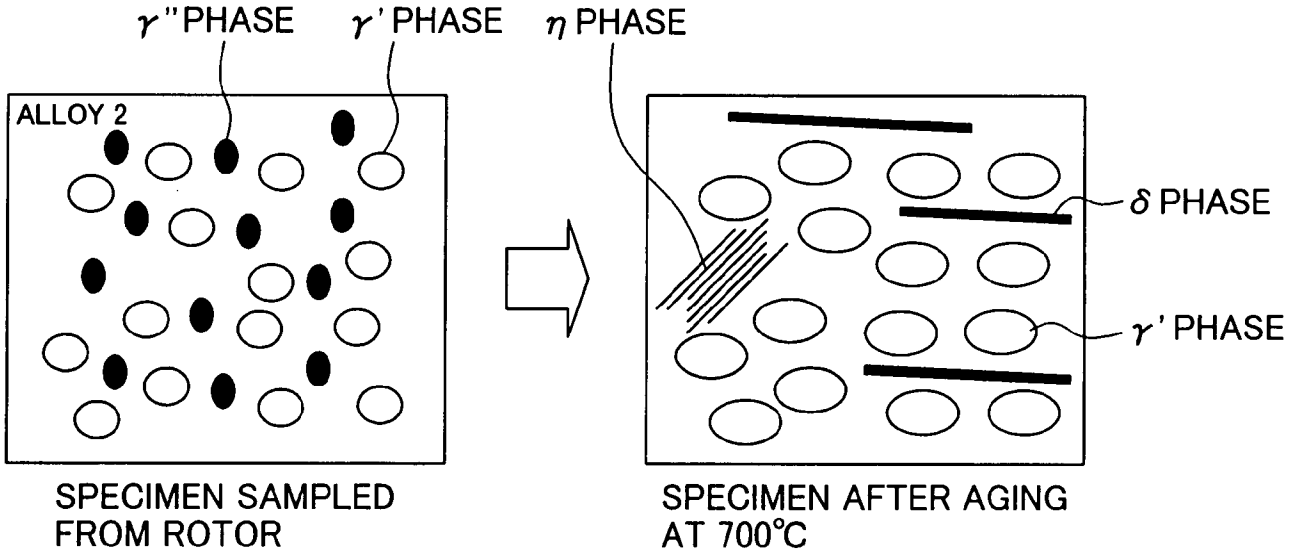
FIG. 2A illustrates the metal structures of Alloy 2 of the Ni—Fe based super alloy according to the present invention before and after aging treatment.
Figure 2B:
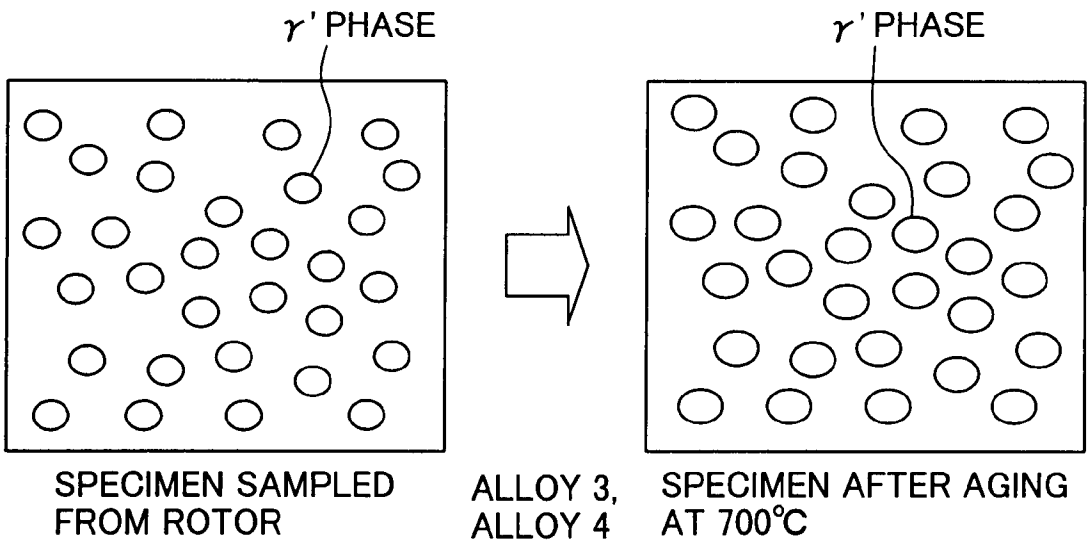
FIG. 2B illustrates the metal structure of Alloys 3 and 4 of the Ni—Fe based super alloy according to the present invention before and after aging treatment.

FIG. 2 illustrates metal structures of the Ni—Fe based super alloy according to the present invention, which were observed by an electron microscope before and after aging treatment at 700° C. Before the aging treatment, the γ" phase and the γ' phase were both precipitated in the alloy 2, and those phases similarly appeared in the structure of the alloy 1. On the other hand, in the alloys 3 and 4, only the spherical γ' phase was precipitated, while the γ" phase was not observed. Since the γ' phase has a specific property of increasing the strength at high temperatures, superiority of the alloys of the present invention in yield point at high temperatures is attributable to the fact that the alloys of the present invention are strengthened by only the γ' phase.

After the aging treatment of the specimen at 700° C., in the alloy 2 as the improved version of the known material, the γ" phase was reduced, while the η and δ phases, each known as a detrimental phase in the super alloy, were precipitated to some extent, although the amounts of the η and δ phases were smaller than those precipitated in the alloy 1. On the other hand, in the alloys 3 and 4 of the present invention, it was observed even after the aging treatment at 700° C. that only the γ' phase was observed in size slightly increased with growth and the detrimental phases were hardly precipitated.

Figure 3:
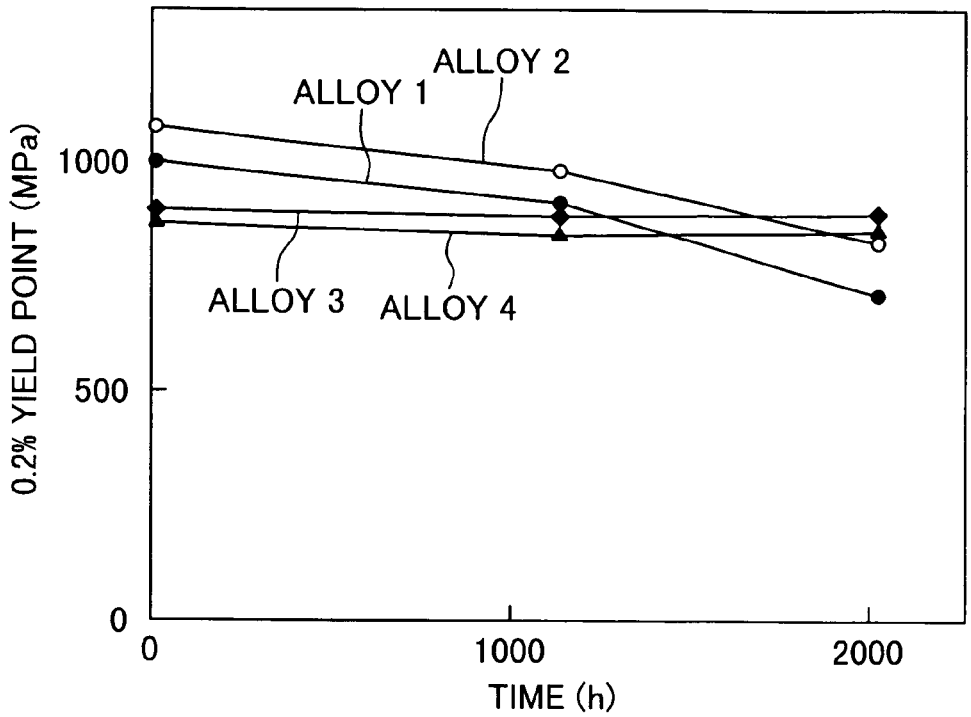
FIG. 3 is a graph showing the relationship between aging treatment time and 0.2% yield point in the Ni—Fe based super alloy according to the present invention.

FIG. 3 is a graph showing the relationship between aging treatment time and 0.2% yield point when the specimens were subjected to the aging treatment at 700° C. With the aging treatment at 700° C., the 0.2% yield point was reduced in the alloy 1 of the known material. On the other hand, in the alloys 3 and 4 of the present invention, the 0.2% yield point at the room temperature was hardly reduced even with the aging treatment at 700° C. In the alloy 2 as the improved version of the known material, the 0.2% yield point was reduced with the aging treatment at 700° C., but it showed a value comparable to those of the alloys 3 and 4.

Figure 4:
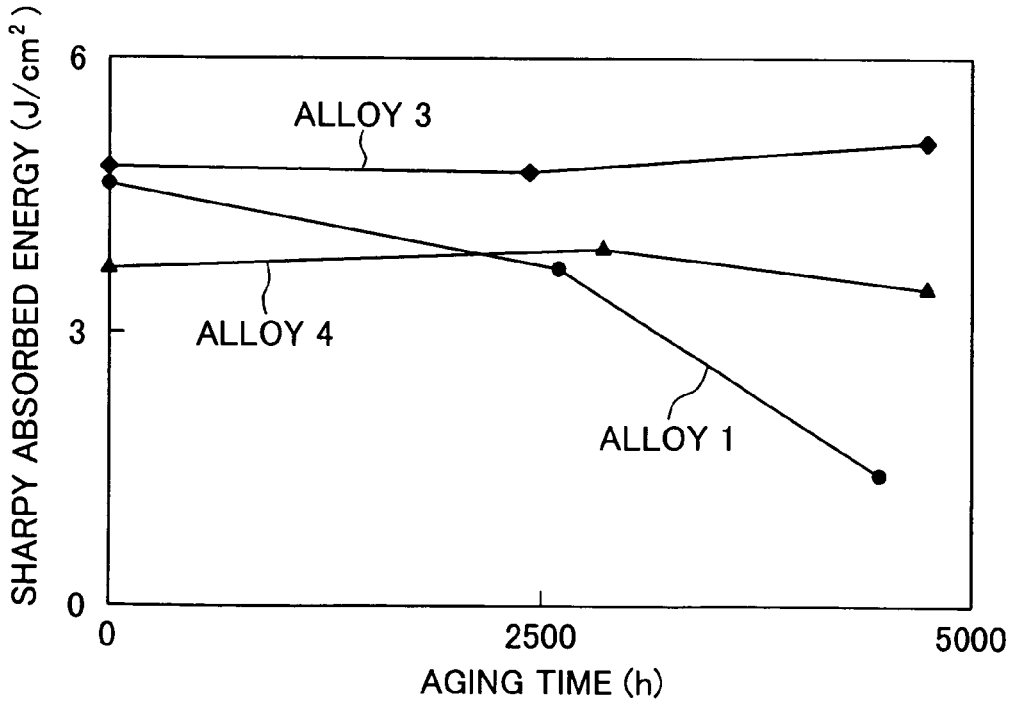
FIG. 4 is a graph showing the relationship between Charpy absorbed energy and aging treatment time in the Ni—Fe based super alloy according to the present invention.

FIG. 4 is a graph showing the relationship between Charpy absorbed energy and aging treatment time when the aging treatment was performed at 700° C. A drop of the Charpy absorbed energy, i.e., embrittlement, was abruptly caused in the alloy 1 of the known material, whereas no embrittlement was caused in the alloys 3 and 4 of the present invention. Such results are attributable to the fact that, with the aging treatment at 700° C., the precipitated strengthening phase was reduced and the detrimental phases were precipitated in the alloy 1 of the known material, whereas the γ' phase serving as the precipitated strengthening phase was not reduced and the detrimental phases were not precipitated in the alloys 3 and 4. It is apparent from those results that the alloys of the present invention are more suitable for use at high temperatures than the known alloy.

Figure 5:
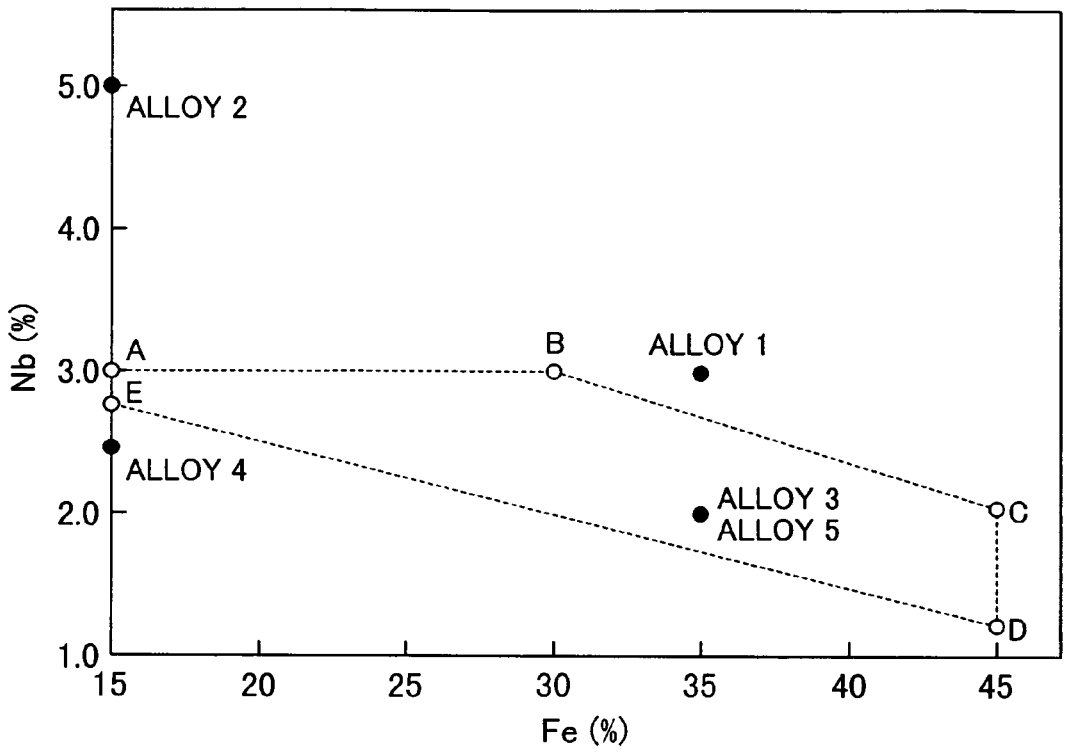
FIG. 5 is a graph showing the relationship between Fe and Nb contents in the Ni—Fe based super alloy according to the present invention.

FIG. 5 is a graph showing the relationship between the Fe and Nb contents in the alloys of the present invention. In the alloys of the present invention, preferably, as described above, it is preferable that no detrimental phases be precipitated at high temperatures. Also, if the Nb content exceeds 3% by weight, productivity in making a large-sized ingot would deteriorate as compared with the known alloy. Therefore, the Nb content is preferably not more than 3% by weight. However, if Nb is added in too small amount, the yield point could not be obtained at a level required as a strength characteristic in the gas turbine rotor material.

For that reason, the contents of Fe and Nb (Fe %, Nb %) are preferably within a region defined, as shown in FIG. 5, by successively connecting a point A (15%, 3.0%), a point B (30%, 3.0%), a point C (45%, 2.25%), a point D (45%, 1.25%), a point E (15%, 2.75%), and the point A.

Figure 6:
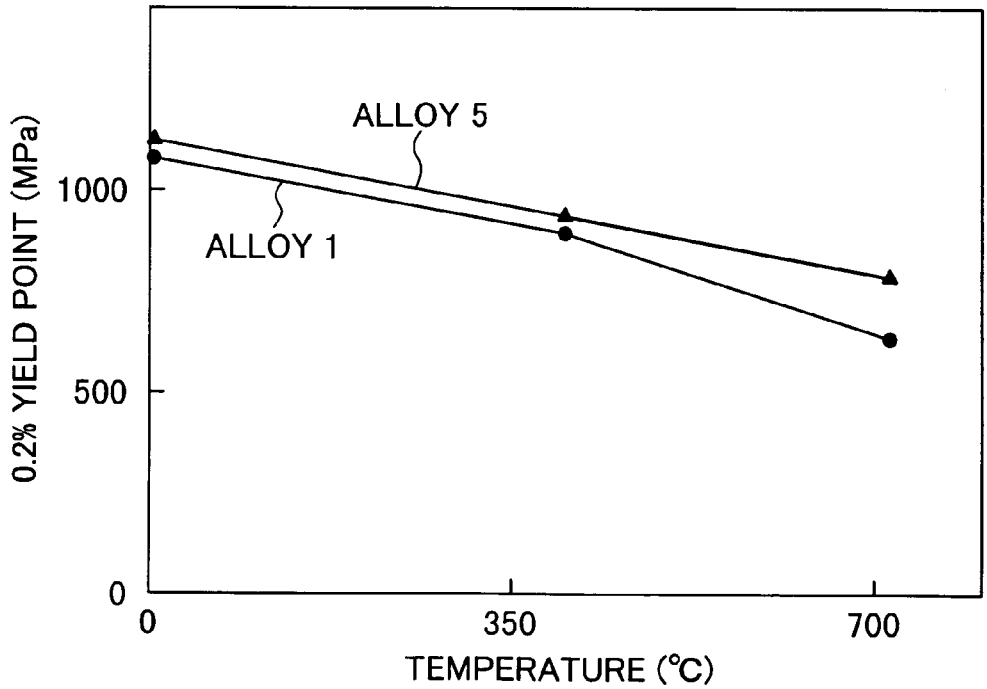
FIG. 6 is a graph showing the relationship between 0.2% yield point and temperature in the Ni—Fe based super alloy according to the present invention.

FIG. 6 is a graph showing the relationship between 0.2% yield point and temperature in the specimens, i.e., the results of tensile tests made on the specimens. As will be seen from FIG. 6, the yield point of the alloy 5 of the present invention, which was obtained by adding a proper amount of N to the alloy 3, was increased from that of the alloy 3, and it was also superior to that of the alloy 1 of the known material in a temperature range of from the room temperature to high temperature.

Figure 7:
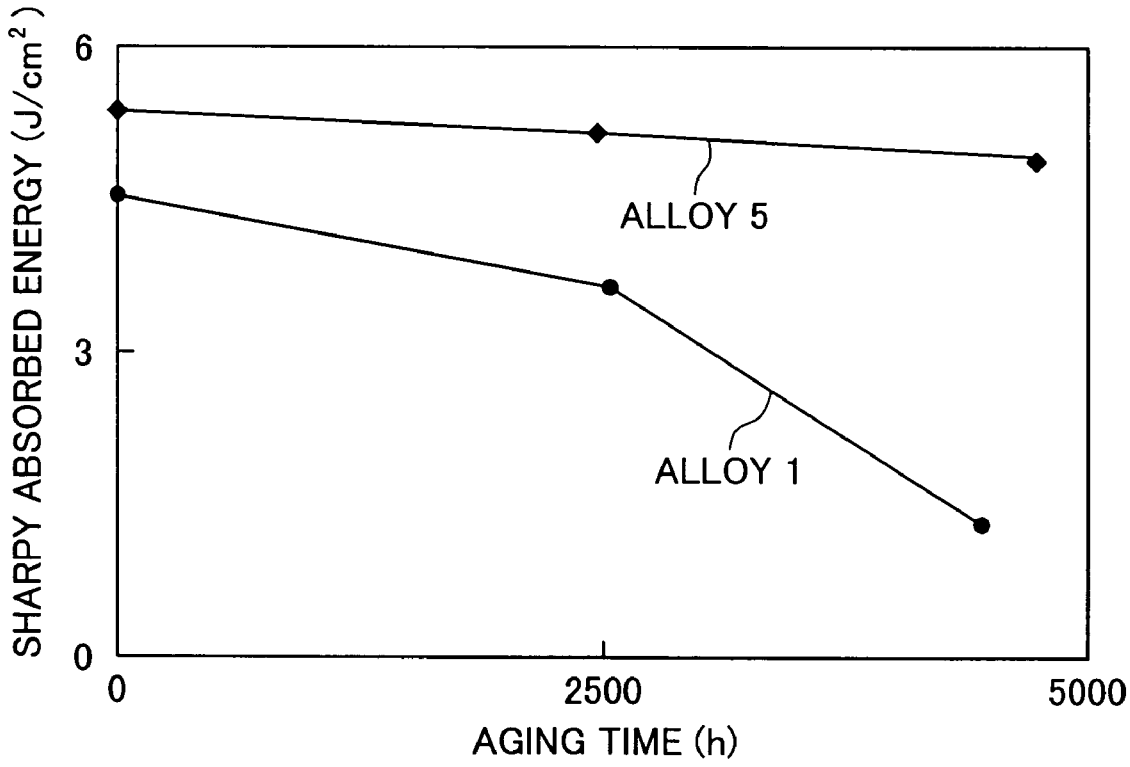
FIG. 7 is a graph showing the relationship between Charpy absorbed energy and aging treatment time in the Ni—Fe based super alloy according to the present invention.

FIG. 7 is a graph showing the relationship between Charpy absorbed energy and aging treatment time when the aging treatment was performed at 700° C. The Charpy absorbed energy of the alloy 5 of the present invention was higher than that of the alloy 1 of the known material even before the heat treatment, and no embrittlement was caused in the alloy 5 even with the aging treatment unlike the alloy 1. The structure of the alloy 5 observed by an electron microscope was the same as these of the alloys 3 and 4 in both states before and after the aging treatment.

Figure 8A:
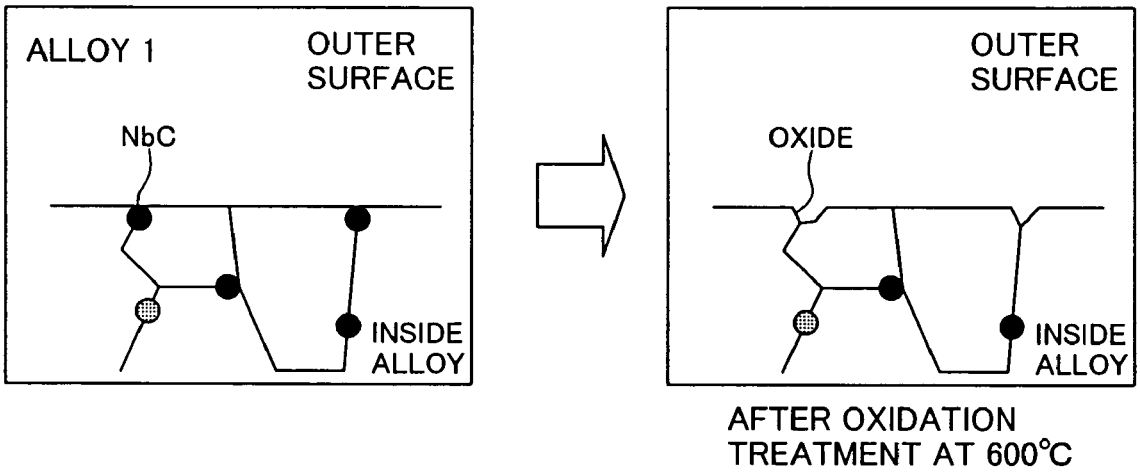
FIG. 8A illustrates the metal structures of Alloy 1 of the Ni—Fe based super alloy according to the present invention before and after aging treatment.
Figure 8B:
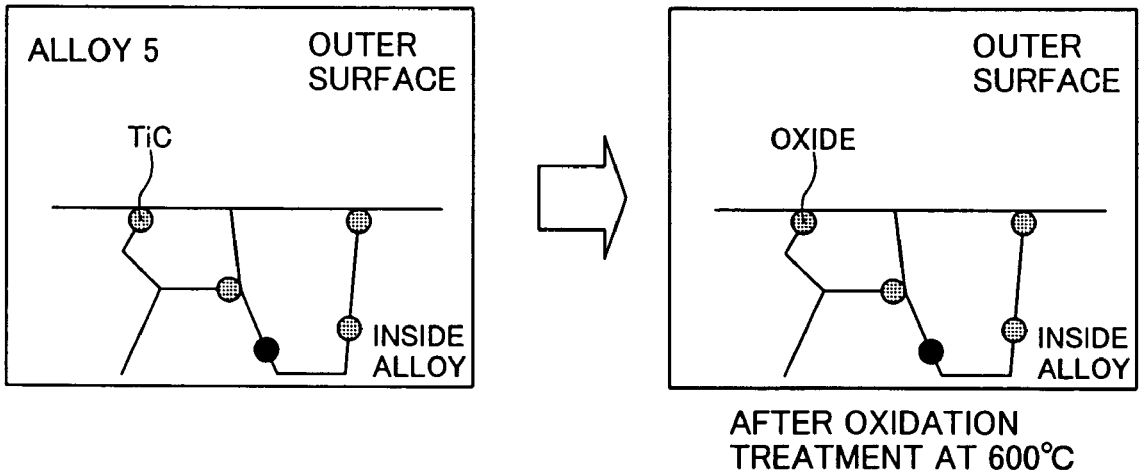
FIG. 8B illustrates the metal structure of Alloy 5 of the Ni—Fe based super alloy according to the present invention before and after aging treatment.

FIG. 8 illustrates metal structures of the Ni—Fe based super alloy according to the present invention, which were observed by an optical microscope before and after oxidation treatment. In the alloy 5 of the present invention, the C content was smaller than in the alloy 1, but the amount of precipitated carbides was comparable because of addition of N. Accordingly, the crystal grain size was also comparable. Also, NbC was observed in large amount in the alloy 1 of the known material, whereas TiC was observed in large amount in the alloy 5. As a result of performing the oxidation treatment on those alloys at 600° C., in the alloy 1 containing a large amount of NbC, NbC in an outer surface of the alloy and surroundings thereof were noticeably oxidized and the carbides were dropped with the oxidation. Those portions causing dropping of the carbides may possibly become crack start points. On the other hand, TiC contained in the alloy 5 in large amount was oxidized on the side near the outer surface, but noticeable oxidation appeared in the surroundings of TiC and defects possibly becoming the crack start points were not caused. This is the reason why the Charpy absorbed energy remain high as mentioned above. From those results, it is understood that finer crystal grains can be formed and the yield point can be increased with addition of N without increasing the number of crack start points.

Thus, according to this embodiment, it is apparent to be able to obtain a Ni—Fe based super alloy capable of suppressing a reduction in both yield point and toughness at high temperatures even when exposed to the high temperatures. Also, the Ni—Fe based super alloy has productivity in making a large-sized ingot comparable or superior to IN718 and IN706. Further, the super alloy can be used at temperatures higher than IN718 and IN706. By using the Ni—Fe based super alloy of the present invention, a gas turbine operating with high efficiency can be provided. Additionally, since it is possible to increase the combustion temperature and the compression ratio and to reduce the amount of cooling air required, a gas turbine operating at even higher thermal can be provided.

Second Embodiment

Figure 9:
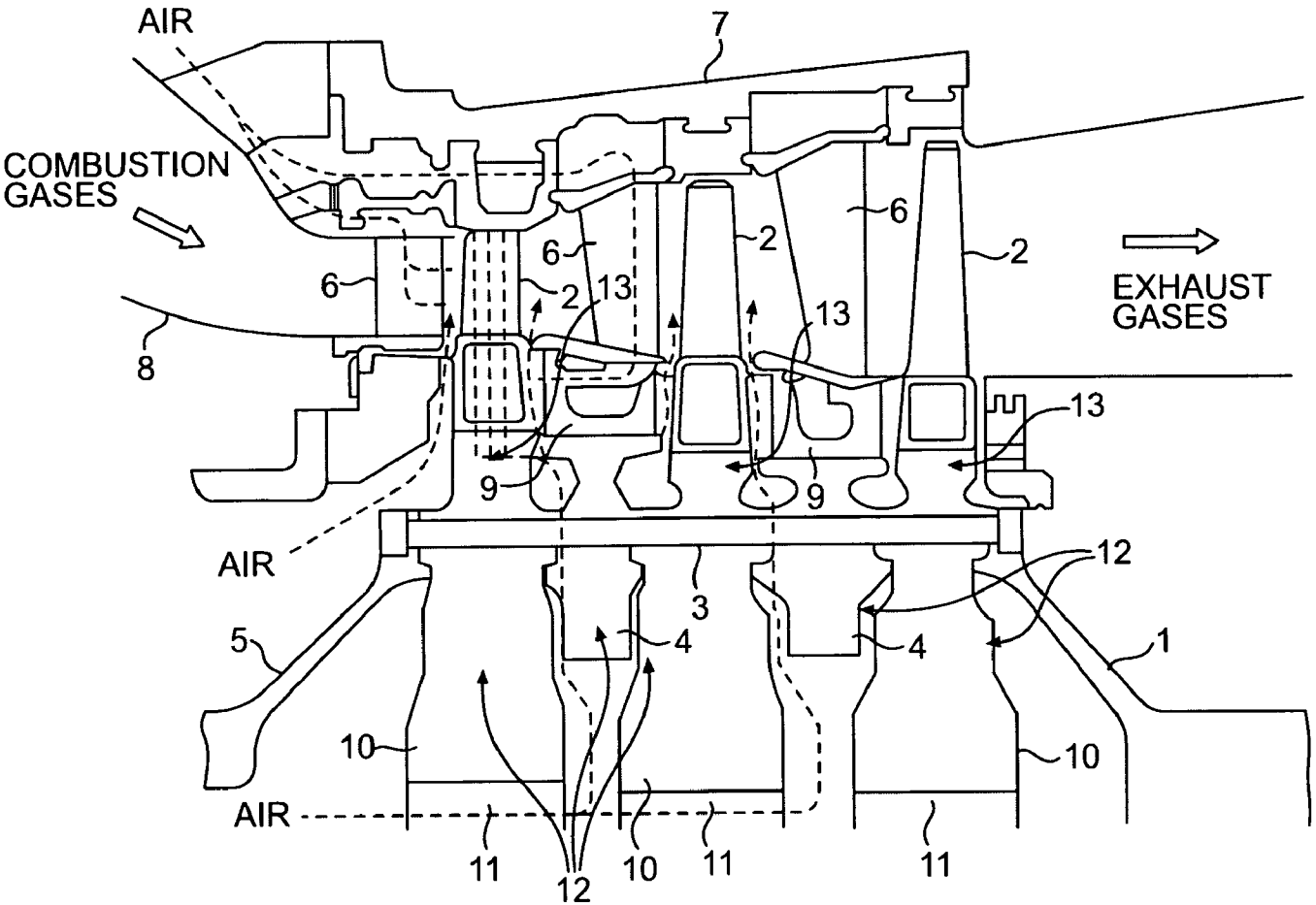
FIG. 9 is a partial sectional view showing a rotating section and thereabout of a gas turbine according to one embodiment of the present invention.

FIG. 9 is a partial sectional view showing a rotating section and thereabout of a gas turbine according to one embodiment of the present invention. As shown in FIG. 9, the gas turbine comprises a turbine stub shaft 1, three stages of turbine blades 2, turbine stacking bolts 3, two annular turbine spacers 4, distant pieces 5, three stages of turbine nozzles 6, a turbine compartment 7, a combustor 8, two stages of annular shrouds 9, three stages of turbine disks 10, and through holes 11. Though not shown, the gas turbine of this embodiment further comprises a distant piece coupled to the turbine disk 10, a plurality of compressor disks coupled to the distance piece, compressor blades mounted to the compressor disks and compressing air, and a compressor stub shaft integrally coupled to a first stage of total 17 stages of the compressor disks. In another case, the turbine blades 2 many be provided in four stages. In any case, the turbine blade disposed on the side of an inlet for combustion gases constitutes a first stage. Then, second and third stages (and, if present, a fourth stage) follow successively downstream. Arrows indicated by dotted lines represent paths of high-temperature cooling air compressed by a compressor and flowing into the gas turbine.

The turbine disks 10 and the turbine spacers 4 in this embodiment were each produced through the steps of melting, by RF vacuum fusion, an alloy having substantially the same composition as the alloy 3 shown in Table 1, then melting it again by electroslag fusion, and successively performing forging, solution treatment and two-stage aging treatment in a similar manner to that in the first embodiment. After the heat treatment for aging, the resulting material was likewise subjected to the tensile test and the V-notch Charpy impact test. As a result, it was confirmed that each specimen had similar characteristics and electron microscopic structure as those of the alloy 3 in the first embodiment. In this embodiment, the three stages of turbine disks 10 and the two turbine spacers 4 were all made of materials having the same composition. Any of those parts was machined into a final shape after the heat treatment.

Each of the turbine disks 10 has an outer diameter of 1000 mm and a thickness of 200 mm with through holes 11 formed therein. Numeral 12 denotes a portion where a hole for insertion of the stacking bolt 3 is formed, and 13 denotes a portion where the turbine blade 2 is mounted. The mount portion is provided by forming an axial recess in the shape of an inverted Christmas tree along all over an outer peripheral portion of the turbine disk 10. A dovetail of the turbine blade 2 is implanted into the mount portion. Additionally, the thickness of the turbine blade 2 in the portion where the hole for insertion of the turbine stacking bolt 3 is formed is slightly larger than that in the portion of the through hole 11, and the turbine blade 2 has the largest thickness in a central portion where the through hole 11 is formed.

Each of the turbine spacers 4 is an annular member and has an insertion hole in a portion where the turbine stacking bolt 3 is to be inserted. Also, the turbine spacer 4 has projections and recesses in the form of comb teeth in engagement with the shroud 9 disposed on the side of the turbine nozzle 6. Further, the turbine spacer 4 has annular bosses supported by the turbine disk 10 when the gas turbine is rotated at high speed.

With the construction described above, the gas turbine is capable of operating at a compression ratio of 14.7, temperature of not lower than 450° C., and the gas temperature of not lower than 1300° at an inlet of the first-stage turbine nozzle, and thermal efficiency (LHV) of not less than 35% can be obtained. Thus, by producing the turbine disks 10 and the turbine spacers 4 using the Ni—Fe based super alloy of the present invention, which has a high yield point at high temperatures and shows less embrittlement under heating as described above, it is possible to provide a gas turbine having higher reliability from the total point of view.

What is claimed is:

1. A Ni—Fe based super alloy consisting of 0.005-0.02% by weight of C, 14-18% of Cr, 15-45% of Fe, 0.5-2.0% of Al, 0.03-0.05% of N, greater than 1.0% and up to 2.0% of Ti, 1.5-5.0% of Nb and the balance being nickel and unavoidable impurities.

2. The Ni—Fe based super alloy according to claim 1, wherein a composition of said super alloy satisfies at least one of 0.005-0.02% by weight of C, 1.0-2.0% of Al, 1.3 to 2.0% of Ti, and 0.03-0.05% of N.

3. The Ni—Fe based super alloy according to claim 1, wherein said super alloy is subjected to aging treatment after plastic working with hot forming.

4. A turbine disk being a disk-shaped member having turbine-blade mount portions in a circumferential region thereof and made of the Ni—Fe based super alloy according to claim 1.

5. A turbine spacer being a ring-shaped member which is disposed between adjacent turbine disks each having turbine-blade mount portions in a circumferential region of each disk and is coupled integrally with said turbine disks by bolts, said ring-shaped member being made of the Ni—Fe based super alloy according to claim 1.

6. A gas turbine comprising a turbine stub shaft, a plurality of turbine disks coupled to said turbine stub shaft by turbine stacking bolts with turbine spacers each interposed between adjacent turbine disks, turbine blades mounted to said turbine disks and rotated by high-temperature combustion gases, and a distant piece coupled to the forward most turbine disk, wherein at least one of said turbine disks and said turbine spacers is made of the Ni—Fe based super alloy according to claim 1.

* * * * *